United States Patent [19]

Parr, Jr.

[11] 4,179,089

[45] Dec. 18, 1979

[54] APERTURED PANEL CORNER MOUNT FASTENER FOR CONCRETE WALLS

[76] Inventor: Guy H. Parr, Jr., P.O. Box 16201, Baltimore, Md. 21210

[21] Appl. No.: 922,139

[22] Filed: Jul. 5, 1978

[51] Int. Cl.[2] ..... F04F 13/00; A47G 1/16

[52] U.S. Cl. ..... 248/216.1; 52/512; 248/201; 248/488

[58] Field of Search ..... 248/216.1, 675, 220.1, 248/201, 475 R, 488; 52/509, 512; 24/73 CP, 73 PP, 73 SP, 67 CF; 40/125 F, 125 H; 160/10

[56] References Cited

U.S. PATENT DOCUMENTS

| | | | |
|---|---|---|---|
| 3,049,323 | 8/1962 | Peterka | 248/488 X |
| 3,078,608 | 2/1963 | Diack | 248/488 X |
| 3,181,662 | 5/1965 | Maertzig | 52/512 X |
| 3,203,142 | 8/1965 | Narmore | 248/475 R X |
| 3,357,667 | 12/1967 | Trammell | 248/201 |
| 3,452,959 | 7/1967 | Ishikawa | 248/488 |
| 3,478,997 | 11/1969 | Goss | 248/488 |
| 3,680,822 | 8/1972 | Kurtz | 248/475 R |
| 3,995,404 | 12/1976 | Thaw | 52/509 X |
| 4,052,831 | 10/1977 | Roberts et al. | 52/509 X |
| 4,094,490 | 6/1978 | Einhorn | 248/547 |

FOREIGN PATENT DOCUMENTS

| | | | |
|---|---|---|---|
| 1185830 | 8/1959 | France | 248/475 R |
| 214458 | 10/1961 | Sweden | 52/509 |

*Primary Examiner*—J. Franklin Foss

*Attorney, Agent, or Firm*—Sughrue, Rothwell, Mion, Zinn and Macpeak

[57] ABSTRACT

A corner mount fastener adapted to mount an apertured panel at its corner to a hard concrete vertical wall is L-shaped in plan configuration, is formed of molded plastic, each leg of which having a base defined by a front vertical wall and a rear stepped vertical wall when mounted to said concrete wall, with a transverse inner wall forming a projecting transverse lip defining a slot to receive the edges of the apertured panel at the received corner. Integral spring fingers project from the stepped portion of the vertical rear wall to frictionally lock the apertured panel to the fastener and mounting pins, supported within vertical integral cylinders between the inner and outer walls, are driven into the concrete wall to lock the fastener to the concrete wall after insertion of the corner of the apertured panel within the fastener slots.

4 Claims, 7 Drawing Figures

APERTURED PANEL CORNER MOUNT FASTENER FOR CONCRETE WALLS

FIELD OF THE INVENTION

This invention relates to fasteners for fastening elements to hard walls such as concrete walls, and more particularly, to a corner mount fastener for fastening a apertured panel at its corners to a hard concrete wall or the like.

BACKGROUND OF THE INVENTION

Picture fasteners and the like have been molded in unitary fashion from plastic and have been provided with drivable, pointed, steel pins with the pins frictionally mounted within cylindrical molded portions of the fastener, and wherein the molded portions act as support for the pins when they are driven inwardly to fix the fastener to the wall.

One such hard wall fastener is shown in U.S. Pat. No. 3,974,557. In that fastener, the steel pins 48 are mounted to cylindrical bushings 45 with the bushings in turn being drivable with respect to cylindrical recesses 41 within the fastener 40, such that both the pins and the bushings are driven axially, with the bushings acting as guides during mounting of the fastener to the hard wall by embedding the steel pins within that hard wall and with the fastener flush to the wall.

The present invention is directed to fasteners of this type, and more particularly, to a unitary, integral, molded plastic fastener for specifically fastening the corner of a sheet, wall board or apertured panel to a hard wall such as a concrete wall and wherein the fastener is both extremely simple to manufacture and is light weight to securely hold the corner of the wall board or pegboard in place during the mounting of the fastener to the wall and which frictionally locks the apertured panel to the fastener.

SUMMARY OF THE INVENTION

The present invention takes the form of a corner mount fastener for fastening a pegboard or the like to a hard concrete or similar type wall, with the fastener comprising a unitary, hollow member and being L-shaped in plan configuration via intersecting legs. Each leg is of modified C-shape in vertical cross-section, defining intersecting slots, facing inwardly, to receive angled, intersecting edges of the apertured panel. The opening of the slots is of a thickness slightly in excess of the thickness of the apertured panel. The fastener comprises a vertical front wall joined by inner and outer transverse walls, forming the slot, and wherein at least one of the transverse walls includes partially cut out, flexible fingers projecting into the plane of the slot to frictionally lock the inserted corner of the apertured panel to the fastener. Vertical, pointed metal pin supporting means extend at spaced positions along at least one of the vertical walls and carry vertical holes bearing individually, hardened, pointed metal pins such that by driving the pins inwardly from the top of the intersecting legs, the fastener may be readily fixed to the hard concrete wall, with the corner of the apertured panel captured within the angled slots of the respective intersecting legs.

Preferably, the vertical supports for the metal pins comprise integral cylinders vertically interposed between the transverse walls and in contact therewith. A large cylinder may be mounted between the outer and inner transverse walls at the corner intersection of the two legs to form a screw hole for auxiliary fixing of the fastener to the concrete wall. Preferably, the fastener is of molded plastic with integral molded flexible fingers. The fingers and the slots defining the same may project obliquely towards the leg intersection to facilitate insertion of the corner of the apertured panel into the intersecting slots of the fastener. One transverse edge of the flexible finger remote from the intersection of the legs may be beveled to further facilitate insertion of the apertured panel corner into the intersecting slots.

DESCRIPTION OF THE PREFERRED EMBODIMENT

Figure 1:
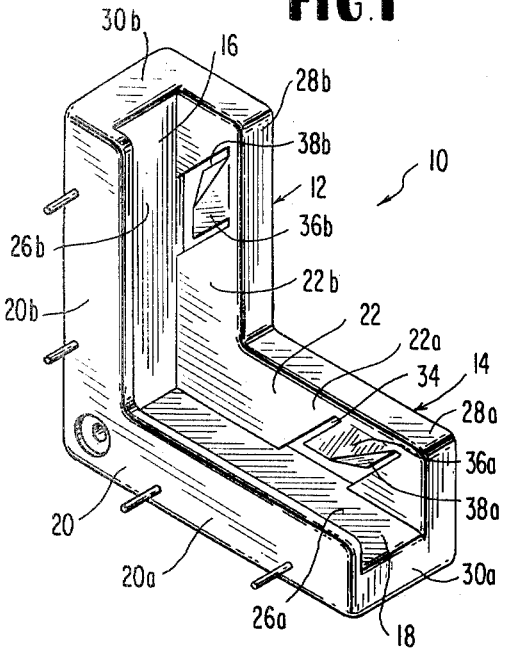
FIG. 1 is a front perspective view of the improved unitary corner mount hard wall fastener of the present invention.
Figure 2:
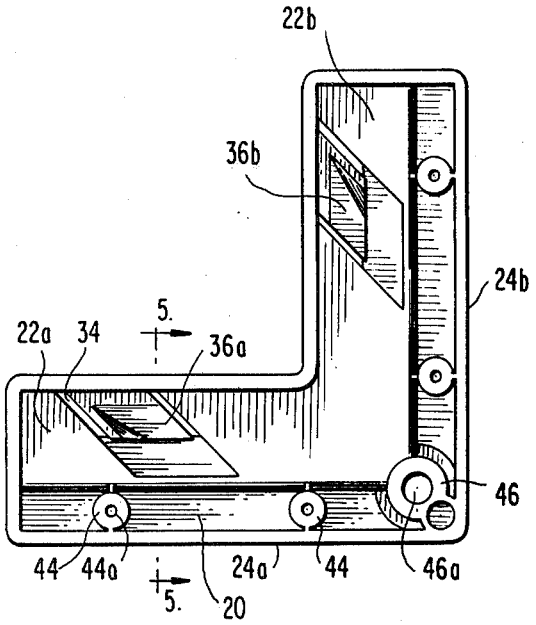
FIG. 2 is a rear elevational view thereof.
Figure 3:
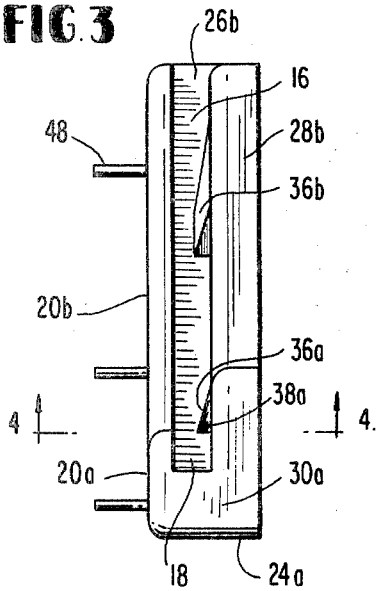
FIG. 3 is an end view of the fastener of FIG. 1.
Figure 4:
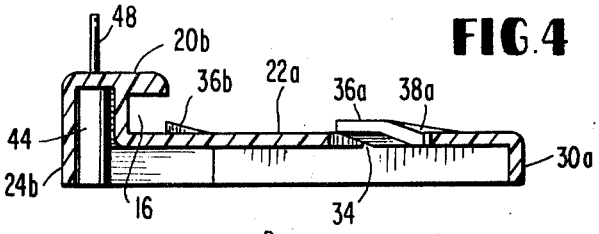
FIG. 4 is a sectional view of a portion of the fastener of FIG. 3 taken about line IV—IV.

Referring to the drawings, the corner mount apertured panel fastener, for use in fastening a apertured panel or similar board at its corners to a hard wall such as a concrete wall or the like, is indicated generally at 10 in FIG. 1 and is generally L-shaped in plan configuration, constituting two right angle sections or legs 12 and 14 which are mirror images of each other. The fastener preferably is unitarily molded of suitable plastic such as acrylic and being completely integral in nature. Each leg, in transverse section, is generally of modified U or C shape in cross-section defining intersecting rectangular slots as at 16 for leg 12, and 18 for leg 14, respectively. Each leg is provided with a front wall which cooperates with a spaced rear wall and has inner transverse wall which joins the front wall to the rear wall. The front wall extends beyond the rear wall to form a flange or lip, which forms in conjunction with the inner transverse wall a given one of the intersecting slots. Thus, for leg 18, a rear wall 22 has portions **22*a* and 22*b* which join at right angle portions 20*a* and 20*b*. Front wall 20 includes right angle portions 20*a* and 20*b* being opposite to and spaced from the rear wall 22 portions of legs 12, 14. The fastener is hollow in construction and has its rear open as per FIG. 2**. Each leg is characterized by a vertical front wall, a vertical rear wall, a transverse outer wall and a transverse inner wall, with the front wall extending joining at the front of the fastener the end of the transverse inner and outer walls and extending beyond the inner wall to form with the vertical rear wall a given apertured panel corner receiving slot.

In this respect, therefore, for leg 14, there is provided a front wall at **20*a*, a vertical rear wall 22*a*, a transverse outer wall 24*a*, a transverse inner wall 26*a*. A transverse flange 20*a* projects rearwardly from the vertical rear wall 22*a*. Right angle leg 12 is similarly defined by a front wall 20*b*, a rear wall 22*b*, a transverse outer wall 22*b*, a transverse inner wall 26*b*, and the vertical rear wall 22b is provided with a right angle flange 28b. These surfaces all meet at the intersection between legs 12 and 14, and the molded plastic fastener further comprises end walls for respective legs as at 30a and 30b respectively which join to the other leg walls at right angles thereto. The back or rear of the molded plastic fastener is open, as may be best seen in FIG. 2, this opening of course being covered by the hard wall when the fastener is applied to the hard wall such as the concrete wall W, FIG. 6**.

In the illustrated embodiment, the rear walls 22a and 22b are each molded with a U-shaped or partial cut out opening as at 34, forming flexible fingers as at 36a for leg 14 and 36b for leg 12. In the molding process, the U-shaped opening 34 is of irregular configuration and of non-uniform dimensions. Further, each one of the flexible fingers is provided with a beveled outer edge relative to the intersection point of the two legs 12 and 14. For instance, finger 36b is provided with a beveled edge 38b, while finger 36a is provided with a beveled edge 38a, FIG. 1.

Further, the fingers are molded so that they do not lie flush with the surface of the rear walls 22a and 22b, but in fact partially project into the slots 16 and 18, as may be seen in FIGS. 3, 4, 5 and 7. The slots 16 and 18 are slightly larger than the thickness of the apertured panel B, FIG. 6 and FIG. 7, such that when the apertured panel B is inserted into the slots 16 and 18, the outer surface 40 of the apertured panel B contacts the front wall 20a and 20b, while the rear surface 42 of the same apertured panel B contacts the flexible fingers as at 36a and 36b.

Figure 6:
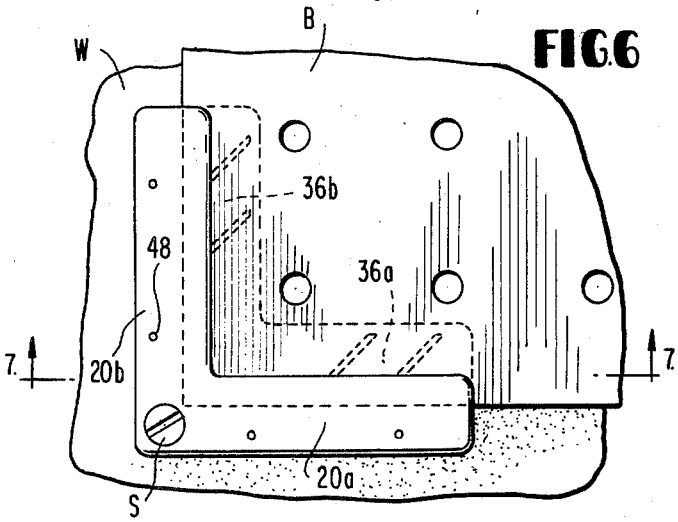
FIG. 6 is a vertical elevational view of the fastener as mounted to a vertical concrete wall and supporting one corner of an apertured panel.
Figure 5:
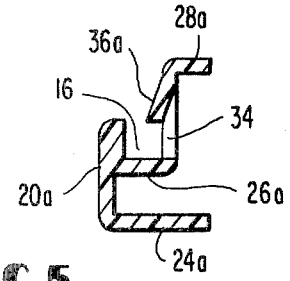
FIG. 5 is a vertical sectional view of a portion of the fastener of FIG. 2 taken about line V—V.
Figure 7:
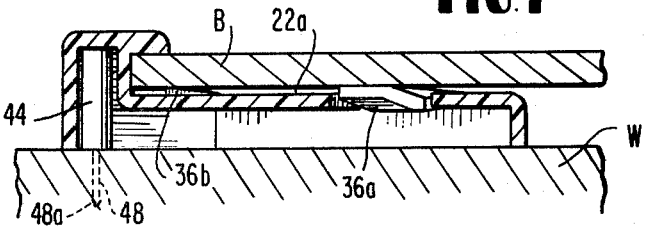
FIG. 7 is a sectional view of the assembly of FIG. 6 taken about line VII—VII.

Important also, is the manner in which the fastener can be secured to the hard wall such as concrete wall W, FIG. 6, FIG. 7. In the illustrated embodiment of the invention, since the fastener 10 is formed of molded acrylic plastic or the like, there is molded integrally with element 10 a plurality of cylinders, as at 44, which extend from the front walls 20a, 20b of legs 12 and 14, to the edges of the rear wall flanges 28a, 28b. Preferably, the cylinders 44 are of a diameter so as to bridge between transverse inner and outer walls 24a, 24b, and transverse inner walls 26a, 26b, in each instance. While two cylinders 44 are provided for each of the legs 12 and 14, any number of such cylinders may be employed, preferably in excess of two.

Additionally, as an alternate mounting means, there is provided a large cylinder 46 between the transverse inner and outer walls at the intersection of the two legs 12 and 14. In this case, cylinder 46 includes a bore 46a which is of a larger diameter than the holes 44a within the cylinders 44. The holes 44a are of a diameter slightly less than the diameter of steel mounting pins 48 which have sharpened ends at 48a. The pins 48 are driven into the holes 44a from the front walls 20a, 20b, so that the head of each pin extends outwardly from the front wall prior to mounting of the fastener to the concrete wall W as per FIGS. 6 and 7. The cylinders 44 at their spaced positions between the inner and outer transverse walls lend rigidity to the molded plastic fastener without a major addition of weight or mass. The presence of the flexible fingers 36a, 36b insures frictional locking of the fastener to the pegboard either prior to the mounting of the fastener to the hard wall W or vice versa, upon receiving a corner of the apertured panel B, or vice versa.

A mounting screw S, FIG. 6, is shown within the hole 46a of the large cylinder 46 for additional rigidity and structural strength to the fastening of the apertured panel B. The pin supporting cylinders do not interfere with the slot reception of the corner of the apertured panel B by the fastener, while permitting a separation or spacing of the attachment points for the fastener with respect to the concrete wall W receiving the fastener. Further, cylinders 44 are spaced sufficiently from the larger cylinder 46 so that the additional support provided by screw S is not affected by the previous or subsequent driving of the pins axially through the cylinders 44 with the pointed ends 48 of the pins being deeply embedded within the concrete wall W, FIG. 7.

While the unitary corner mount fastener 10 of the present invention is illustrated as being formed of molded plastic, it may be formed of a completely different material, such as metal or the like, as long as the metal exhibits the spring characteristics necessary to provide the flexible locking fingers 36a, 36b for frictionally locking the apertured panel B at its corner to the corner receiving fastener 10.

While the invention has been particularly shown and described with reference to a preferred embodiment thereof, it will be understood by those skilled in the art that various changes in form and details may be made therein without departing from the spirit and scope of the invention.

What is claimed is:

1. A corner mount fastener for fastening a pegboard or the like at its corner to a hard concrete wall or the like, said fastener comprising:

a unitary, hollow member of L-shaped configuration formed of intersecting legs, each leg including a portion of modified U-shape in transverse cross-section formed by a vertical front wall, a vertical rear wall and transverse outer and inner walls, with the transverse inner wall joining the rear wall to the front wall at a point such that said front wall extends beyond said transverse inner wall to form with the vertical rear wall a slot which intersects with the slot of the other leg of said corner mount fastener, at least one of said inner front or rear walls is partially cut out to form a flexible finger which projects into said slot, said slot being of a transverse dimension slightly in excess of the thickness of said apertured panel whereby, said pegboard is frictionally gripped by said fastener when said corner is inserted within said intersecting slot, and wherein said fastener further comprises vertical mounting pin supporting means extending within both legs and transversely over at least the distance between said front wall and said rear wall and being positioned between the transverse inner and outer walls, transversely extending holes within said support means and pointed metal pins mounted within said holes and having their head ends projecting outwardly of the front wall.

whereby, the corner of said apertured panel may be mounted to the corner mount fastener with respective edges of said apertured panel at its corner within respective slots defined by said intersecting legs and being frictionally held by said flexible fingers, and said pins may be driven through said support means from said front wall towards said rear wall, with the pointed ends embedded some distance within said hard concrete wall.

2. The corner mount fastener as claimed in claim 1, wherein said support means comprises a plurality of spaced cylindrical members positioned between said inner and outer transverse walls and in contact on opposite sides with respective walls.

3. The corner mount fastener as claimed in claim 2, wherein said unitary hollow member is formed of molded plastic including said flexible fingers, and wherein a large diameter cylinder is integrally molded between said transverse inner and outer walls at the corner of said legs and is provided with a relatively large diameter hole for receiving a screw to permit auxiliary mounting of said fastener to said hard concrete wall.

4. The corner mount fastener as claimed in claim 3, wherein said fingers are provided with beveled edges along the side of said fingers remote from the area of intersection of said legs at the face of said fingers projecting into said slot so as to facilitate insertion of said apertured panel into the slots of said corner mount fastener.

* * * * *